US005117541A

United States Patent [19]

Leuchtenmüller

[11] Patent Number: 5,117,541

[45] Date of Patent: Jun. 2, 1992

[54] APPARATUS FOR NEEDLING A NONWOVEN WEB

[75] Inventor: Rudolf Leuchtenmüller, Schwertberg, Austria

[73] Assignee: Textilmaschinenfabrik Dr. Ernst Fehrer Aktiengesellschaft, Leonding, Austria

[21] Appl. No.: 637,228

[22] Filed: Jan. 3, 1991

[30] Foreign Application Priority Data

Jan. 18, 1990 [AT] Austria ..... 101/90

[51] Int. Cl.[5] ..... D04H 18/00

[52] U.S. Cl. ..... 28/115

[58] Field of Search ..... 28/115, 107, 109, 114, 28/111, 108, 110, 113; 156/148

[56] References Cited

U.S. PATENT DOCUMENTS 4,651,393 3/1987 Dilo et al. ..... 28/111

FOREIGN PATENT DOCUMENTS 0183952 1/1989 European Pat. Off. .

*Primary Examiner*—Werner H. Schroeder
*Assistant Examiner*—Amy Brooke Vanatta
*Attorney, Agent, or Firm*—Collard, Roe & Galgano

[57] ABSTRACT

In an apparatus for needling a web, which apparatus comprises a brushlike web support consisting of individual brush plates, it is desired to substantially eliminate an influence of the joints between the brush plates on the surface pattern of the needled nonwoven web. To that end the bristle tufts of those rows of tufts which extend adjacent to and along the joints between the brush plates are carried individually or in groups in alternation by the two brush plates which are disposed on opposite sides of the joint.

3 Claims, 1 Drawing Sheet

APPARATUS FOR NEEDLING A NONWOVEN WEB

BACKGROUND OF THE INVENTION

1. Field of the Invention

This invention relates to an apparatus for needling a nonwoven web, comprising a brushlike endless web support, which is trained around reversing pulleys and consists of individual brush plates provided with tufts of web-supporting bristles arranged in rows of tufts which are continued on adjacent brush plates.

2. Description of the Prior Art

In order to avoid the disadvantages of stationary perforated or lamellar brush plates it is known (EP-B-183 952) to provide a traveling endless brushlike web support, which is trained around reversing pulleys and is composed of individual brush plates provided with bristle tufts arranged in longitudinal and transverse rows, which continuously extend throughout the length and width of the web support. To provide the bristles in a distribution which is as dense as possible over the web-supporting surface, said longitudinal and transverse rows of tufts are relatively offset so that the spacing of the mutually offset rows of tufts is decreased whereas a minimum spacing between adjacent tufts of bristles is ensured. But that decrease of the spacing of the rows of tufts involves difficulties at the joints between adjacent brush plates because with brush plates having straight edges the fact that the row spacing is smaller than the tuft spacing requires that the spacing of the marginal rows of tufts is larger than the row spacing on one brush plate. For this reason the brush plates mesh at their joints like meshing teeth and each bristle tuft of each marginal row of tufts is carried by a triangular tooth of the associated edge of the plate. In spite of that measure a uniform distribution of tufts on each brush plate cannot be provided at the joint between two brush plates and, as a result, the joints between the brush plates, which joints extend throughout the width and length of the web support, will be apparent in the surface pattern of the needled nonwoven web. In this connection it must be borne in mind that the bristle density will influence the resistance of the web support to the penetration of the needles and, as a result, will influence the formation of loops in the region in which the needle points emerge from the nonwoven web.

SUMMARY OF THE INVENTION

For this reason it is an object of the invention to avoid said disadvantages and to improve with simple means and in such a manner an apparatus which is of the kind described first hereinbefore and serves to needle a nonwoven web that inevitable irregularities in the distribution of tufts at the joints between the brush plates will not disturb the surface pattern of the needled nonwoven web.

This object set forth is accomplished in accordance with the invention in that the bristle tufts of those rows of tufts which extend adjacent to and along the joints between brush plates are carried individually or in groups in alternation by the two brush plates which are disposed on opposite sides of the joint.

As a result, the bristle tufts of the rows of tufts which are adjacent to a joint are distributed to the brush plates disposed on both sides of the joint so that the irregularities existing between two marginal rows of tufts of adjacent brush plates as regards the distribution of the tufts cannot be continuous throughout the width or length of the web support because a row of tufts extending adjacent to the joint will be continued, at least after a certain number of bristle tufts disposed on one side of the joint, by a group of bristle tufts disposed on the other side of the joint that is offset between said groups of tufts. As a result, the irregularities which are inevitable adjacent to the joint will be offset relative to each other in alternation just as the joint, which is offset in alternation at least between two rows of tufts extending along the joint so that said irregularities will hardly affect the surface pattern of the needled nonwoven web. If individual bristle tufts of the rows of tufts extending along the joints between brush plates are associated in alternation with the brush plates disposed on both sides of the joint, it will be possible to provide the most advantageous conditions as regards the distribution of tufts although it will be necessary to design the edges of the brush plates with a very delicate pattern. If groups of bristle tufts are associated with the individual brush plates, the edges of the plates will have a coarse design, which is suitable for relatively high loads. That division into groups may coincide in certain cases with the edge length of the brush plates so that adjacent brush plates aligned in the direction of the joint can be offset by at least one row of tufts transversely to the joint and the individual brush plates may then have straight edges under certain circumstances.

To ensure that the bristle tufts of a row of tufts extending at a joint between brush plates can be associated, individually or in groups, in alternation, with the brush plates disposed on both sides of that joint, adjoining brush plates may mesh like meshing teeth in a manner known per se adjacent to the joint and in that case the height of the teeth must be at least as large as the tuft spacing of those rows of tufts which extend transversely to the joint so that a continuation of the row of tufts across the meshing teeth will be ensured.

DETAILED DESCRIPTION OF THE PREFERRED EMBODIMENT

Figure 1:
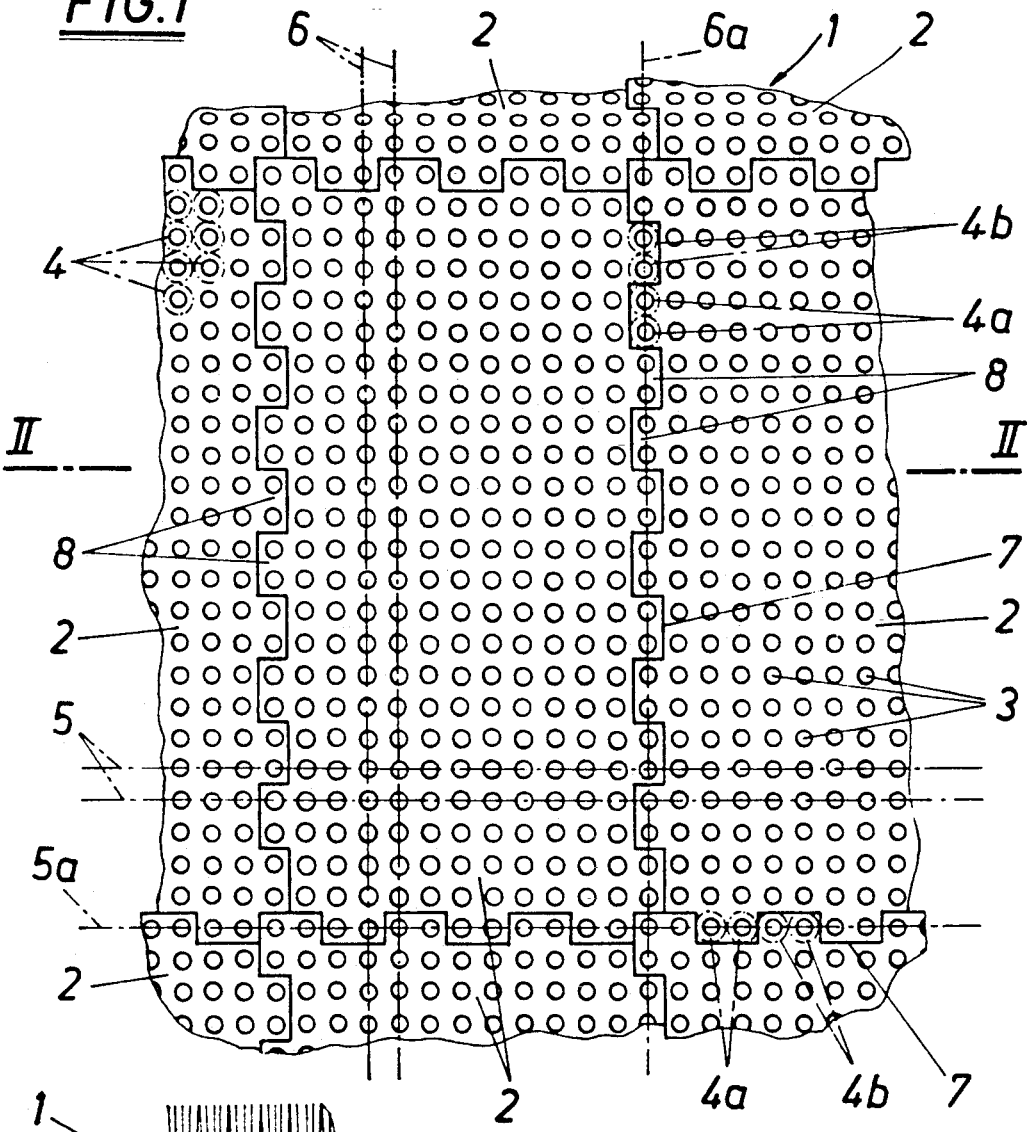
FIG. 1 shows an apparatus in accordance with the invention for needling of a nonwoven web in a diagrammatic top plan view on the web support.
Figure 2:
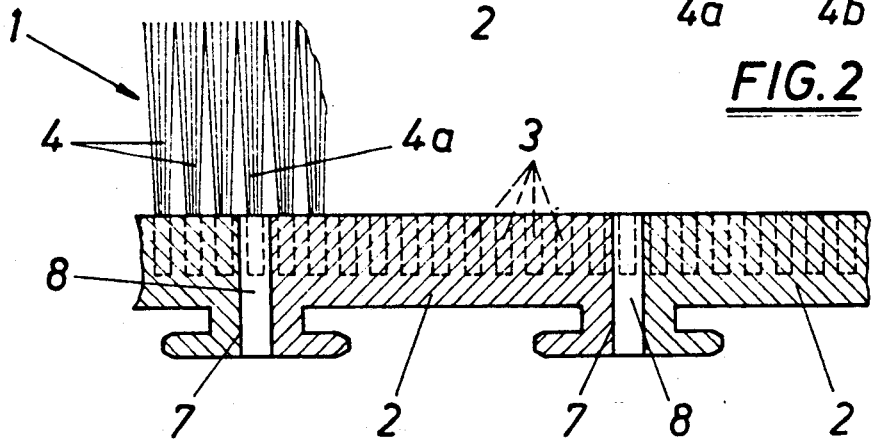
FIG. 2 is a sectional view taken on line II—II in FIG. 1.

An illustrative embodiment of the invention is shown in the drawing.

Except for the web support, the needling apparatus is conventional and for that reason is not illustrated. The web support 1 essentially consists of an endless tensile element, which is trained around reversing pulleys and to which brush plates 2, which adjoin in the longitudinal and transverse directions, are secured by suitable holders. The brush plates 2 carry bristle tufts 4, which have been inserted into receiving holes 3. The bristle tufts 4 are arranged in longitudinal rows 5 and transverse rows 6, which are continued between adjoining brush plates 2.

To permit a compensation of irregularities regarding the spacing between the marginal tufts 4 of adjoining brush plates 2 owing to minimum distances to be provided, resulting clearances or the results of wear, the bristle tufts **4*a* and 4*b* of the rows of tufts 5*a* and 6*a* extending along the joint 7 between brush plates 2 are provided in pairs in alternation on the brush plates 2 arranged on both sides of the joint 7. For that reason the brush plates 2 are provided with teeth 8, which carry respective pairs of bristle tufts 4***a* and 4*b* and by means of which the brush plates 2 mesh at the joint. Because the height of said teeth 8 equals the tuft spacing of the row of tufts which extends transversely to the joint, the bristle tufts 4*a* and 4*b* of the rows of tufts 5*a* and 6*a* extending along the joint 7 are carried in alternation by the teeth 8 of the meshing brush plates 2. As a result, the joint 7 consists of sections which are offset by at least one row of tufts, as is clearly apparent from the drawing.

If the spacing of immediately adjacent marginal tufts of adjoining brush plates 2 at the joint exceeds the spacing of the bristle tufts of a brush plate, the resulting irregularities will also require offsets corresponding to the course of the joint and this will hardly affect the visible surface pattern of the needled nonwoven web, contrary to the irregularities which extend along straight lines throughout the length and width of the web.

It will be understood that the invention is not restricted to the embodiment shown by way of example. For instance, individual rows of tufts 5 and 6 might be offset from each other so that the selected row spacing may be smaller than the tuft spacing. In that case the contours of the teeth will be substantially at right angles to the direction in which the tufts are spaced apart so that the marginal tufts will have a certain spacing from the edge. Obviously the bristle tufts need not be associated with the adjoining brush plates in groups of two in alternation. Said association in alternation may well be restricted to individual tufts or groups composed of a larger number of bristle tufts may be formed. It is merely essential that the sections of the joint between the brush plates are offset by at least one row of tufts so that the tufts of that row do not belong only to the plates disposed on one side of the joint but are divided between the plates on both sides of the joint.

I claim:

1. In an apparatus for needling a nonwoven web comprising an endless web support composed of a plurality of brush plates defining joints between adjacent brush plates, said brush plates being provided with bristle tufts constituting a web-supporting structure, the bristle tufts being arranged in rows of tufts extending along and across said joints, the improvement comprising a marginal row of tufts extending in a straight line along and parallel to each joint, said marginal row comprising a plurality of row sections each of which consists of at least one tuft and the row sections being carried in alternation by the two adjacent brush plates disposed on opposite sides of said joint.

2. The improvement set forth in claim 1, wherein each of said row sections consists of a plurality of said tufts.

3. The improvement set forth in claim 1, wherein the row sections carried in alternation by the two adjacent brush plates are meshing teeth, adjacent ones of the bristle tufts in each row being spaced from each other and the meshing teeth having a height at least as large as the spacing between the adjacent bristle tufts across said joint, the height extending across the joint.

* * * * *